US005946368A

United States Patent [19]

Beezley

[11] Patent Number: 5,946,368

[45] Date of Patent: Aug. 31, 1999

[54] PEDESTRIAN TRAFFIC COUNTING SYSTEM

[76] Inventor: Eugene A. Beezley, 2834 E. Pine Dr., Crete, Ill. 60417

[21] Appl. No.: 08/934,939

[22] Filed: Sep. 22, 1997

[51] Int. Cl.[6] ..... G06M 7/00

[52] U.S. Cl. ..... 377/6; 377/17

[58] Field of Search ..... 377/3, 6, 17, 10, 377/4, 5

[56] References Cited

U.S. PATENT DOCUMENTS

| | | | |
|---|---|---|---|
| 540,090 | 5/1895 | Ellis | 377/6 |
| 898,675 | 9/1908 | Parr | 346/40 |
| 2,262,435 | 11/1941 | Waterman | 235/99 A |
| 3,346,866 | 10/1967 | Bechtel | 346/40 |
| 4,000,400 | 12/1976 | Elder | 377/2 |
| 4,122,331 | 10/1978 | Tsubota et al. | 377/6 |
| 4,630,110 | 12/1986 | Cotton et al. | 348/153 |
| 4,799,243 | 1/1989 | Zepke | 377/6 |
| 5,574,762 | 11/1996 | Sato et al. | 377/6 |

*Primary Examiner*—Kenneth B. Wells
*Assistant Examiner*—Hai L. Nguyen
*Attorney, Agent, or Firm*—Barnes & Thornburg

[57] ABSTRACT

A counting apparatus including a sensor surface having a plurality of zone locations with pressure actuated switches which produce a contact event signal corresponding to the zone location when an object traveling across the sensor surface contacts the zone location, a microprocessor connected to the pressure actuated switches having software for analyzing the contact event signals according to predetermined temporal and spatial criteria stored in the memory of the microprocessor, the microprocessor producing an increment signal when a sequence of contact event signals satisfies one set of criteria related to "in" counts and a second increment signal when a sequence satisfies another set of criteria related to "out" counts, and a counter with a two-channel count register which increments one channel in response to an "in" increment signal and increments a second channel in response to an "out" increment signal.

15 Claims, 20 Drawing Sheets

TABLE 3A

| ZONE | TIME | QTn | |
|---|---|---|---|
| Q1 | 1 | 00 | |
| | | | 0.0 |
| Q2 | 2 | 00 | |
| | | | 0.2 |
| Q3 | 16 | 0.2 | |
| | | | 0.3 |
| Q4 | 14 | 0.5 | |
| | | | 2.0 |
| Q5 | 5 | 2.5 | |
| | | | 0.0 |
| Q6 | 11 | 2.5 | |

TABLE 3B

| ZONE | TIME | QTn | |
|---|---|---|---|
| QA | 2 | 0.0 | |
| | | | 0.2 |
| QB | 16 | 0.2 | |
| | | | 0.3 |
| QC | 14 | 0.5 | |
| | | | 2.0 |
| QD | 5 | 2.5 | |
| | | | 0.0 |
| QE | 11 | 2.5 | |
| QF | 0 | 0 | |

TABLE 3C

| ZONE | TIME | QTn | |
|---|---|---|---|
| QA | 2 | 0.0 | |
| | | | 0.2 |
| QB | 16 | 0.2 | |
| | | | 0.3 |
| QC | 14 | 0.5 | |
| QD | | | |
| QE | | | |
| QF | | | |

TABLE 3D

| ZONE | TIME | QTn | |
|---|---|---|---|
| QA | 5 | 2.5 | |
| | | | 0.0 |
| QB | 11 | 2.5 | |

(SUBROUTINE A)

(SUBROUTINE B)

(SUBROUTINE C)

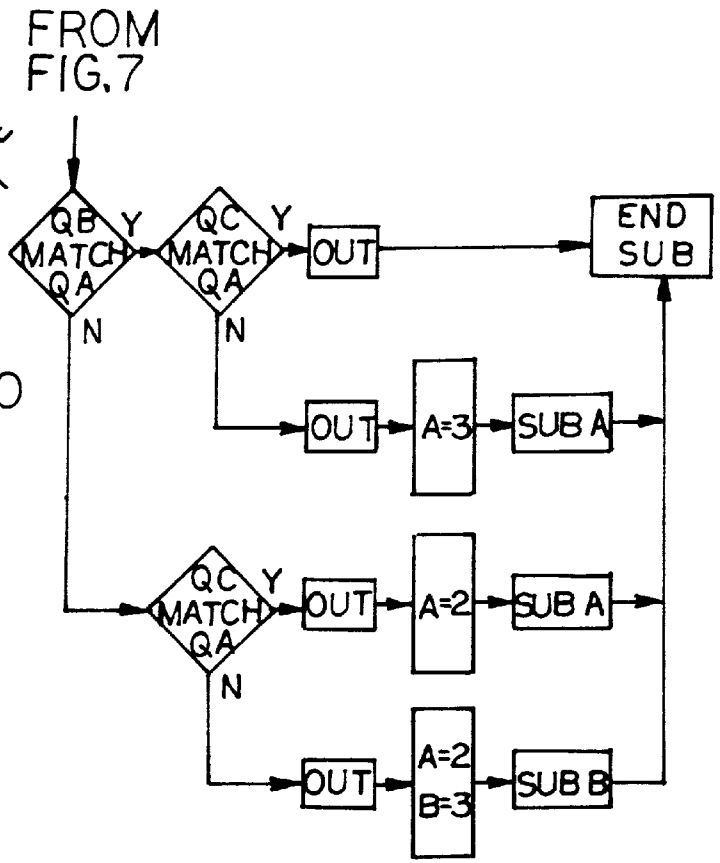
FIG. 7b (SUBROUTINE C)
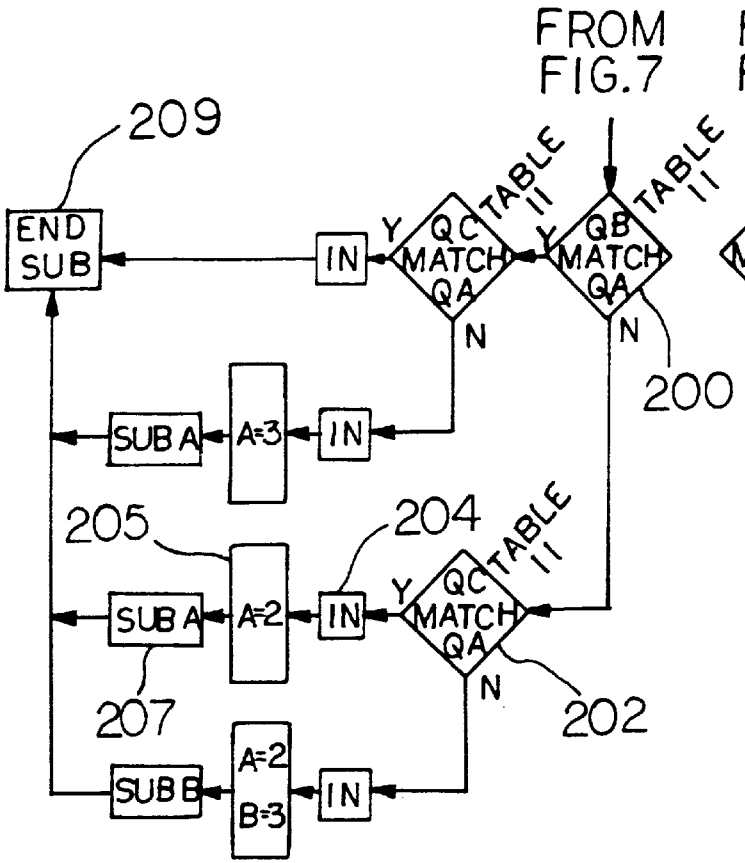
FIG. 7a (SUBROUTINE C)

(SUBROUTINE D)

(SUBROUTINE D)

(SUBROUTINE D)

(SUBROUTINE E)

(SUBROUTINE E)

(SUBROUTINE E)

(SUBROUTINE F)

(SUBROUTINE F)

(SUBROUTINE F)

| 1ST. EVENT | 2ND, 3RD EVENTS ANY OR ALL OF | | | |
|---|---|---|---|---|
| 1 | 7 | 8 | 13 | |
| 2 | 7 | 8 | 9 | 14 |
| 3 | 8 | 9 | 10 | 15 |
| 4 | 9 | 10 | 11 | 16 |
| 5 | 10 | 11 | 12 | 17 |
| 6 | 11 | 12 | 18 | |

TABLE 11

| 1ST. EVENT | 2ND 3RD EVENTS ANY OR ALL OF | | | |
|---|---|---|---|---|
| 7 | 13 | 14 | | |
| 8 | 13 | 14 | 15 | |
| 9 | 14 | 15 | 16 | |
| 10 | 15 | 16 | 17 | |
| 11 | 16 | 17 | 18 | |
| 12 | 17 | 18 | | |

TABLE 12

FIG. 11

| 1 ST. EVENT | 2 ND, 3RD EVENTS ANY OR ALL OF | | | |
|---|---|---|---|---|
| 13 | 7 | 8 | 1 | |
| 14 | 7 | 8 | 9 | 2 |
| 15 | 8 | 9 | 10 | 3 |
| 16 | 9 | 10 | 11 | 4 |
| 17 | 10 | 11 | 12 | 5 |
| 18 | 11 | 12 | 6 | |

TABLE 13

| 1 ST. EVENT | 2 ND 3RD EVENTS ANY OR ALL OF | | | |
|---|---|---|---|---|
| 7 | 1 | 2 | | |
| 8 | 1 | 2 | 3 | |
| 9 | 2 | 3 | 4 | |
| 10 | 3 | 4 | 5 | |
| 11 | 4 | 5 | 6 | |
| 12 | 5 | 6 | | |

TABLE 14

FIG. 12

PEDESTRIAN TRAFFIC COUNTING SYSTEM

BACKGROUND AND SUMMARY OF THE INVENTION

The present invention relates generally to a method and apparatus for electronically counting the number of objects that travel across and make contact with a sensing surface and more particularly to a method and apparatus for electronically counting the number of people within a particular area by sensing the footsteps of the people traveling across a sensor mat at the entrance/exit of the area and computing the number of people and their direction of travel.

For various commonly known reasons related to marketing, crowd control, and crowd monitoring, it is desirable to record the number of people passing through an opening, such as a doorway, into an interior space, such as a department in a department store. Furthermore, it is often desirable to maintain a running total of the number of people in a particular area.

The present invention provides a pedestrian traffic counting system for counting the number of people traveling into and out of an area. The net flow of people may be calculated from the count of people entering the area and the count of people exiting the area. The counting system includes a sensor surface or mat having a plurality of zone locations with pressure sensitive switches for producing contact event signals when objects, such as human feet, make contact with the zone locations, a microprocessor connected to the sensor mat having software for analyzing the contact event signals, and a two-channel counter including an "in" count register for recording the number of people entering the area and an "out" count register for recording the number of people exiting the area. The software controls the microprocessor, causing it to scan the sensor mat to detect contact events and analyze groups of contact events corresponding to pedestrian traffic sequences. The traffic sequences are analyzed by evaluating the temporal and spatial relationships between the contact events using predetermined criteria. When a traffic sequence corresponds to the criteria associated with a person traveling over the sensor mat in the "in" direction, the microprocessor adds one to the "in" count register of the counter. Likewise, when a traffic sequence corresponds to the criteria associated with a person traveling in the "out" direction, the microprocessor adds one to the "out" count register of the counter.

Other features of the present invention will become apparent upon consideration of the following description of exemplary embodiments and the accompanying drawings.

BRIEF DESCRIPTION OF THE DRAWINGS

FIGS. 7, 7*a,* and 7*b* are logic diagrams of a software subroutine for analyzing three contact events.

FIGS. 11 and 12 are tabular illustrations of the predetermined spatial relationships between contact events employed by the software of the present invention.

DESCRIPTION OF EMBODIMENTS OF THE INVENTION

The embodiments described herein are not intended to be exhaustive or to limit the invention to the precise forms disclosed. Rather, the embodiments selected for description are disclosed so that others skilled in the art may utilize their teachings.

Figure 1:
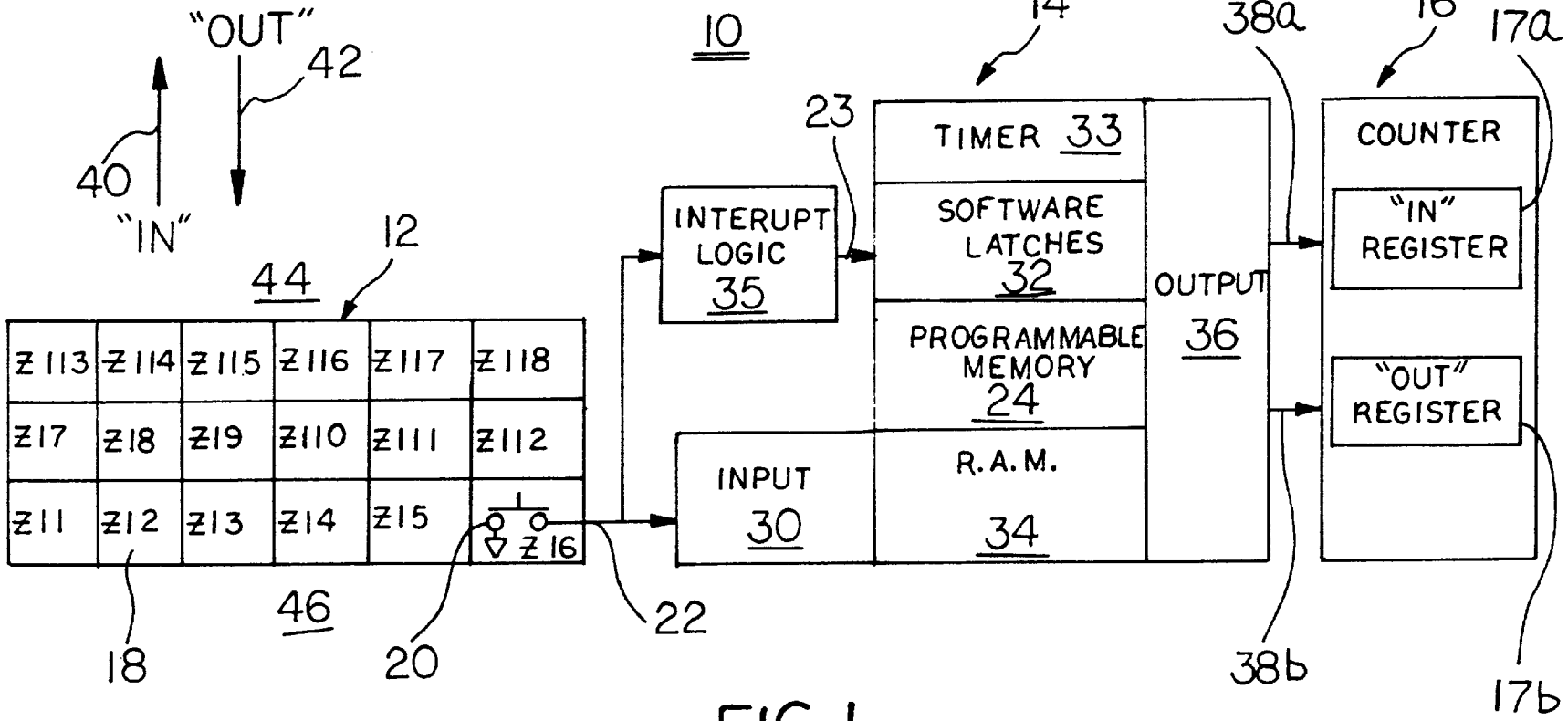
FIG. 1 is a block diagram of a counting system according to the present invention.

FIG. 1 shows components of the counting system of the present invention, referred to by the designated 10. Counting system 10 generally includes a sensor surface or mat 12, an interrupt logic circuit 35, a microprocessor 14, and a two-channel counter 16. Sensor mat 12 includes a plurality of zone locations 18. In the embodiment shown, sensor mat 12 includes three rows of zone locations 18, each row containing six locations. For convenience, individual zone locations 18 will hereinafter be referred to by designations ZL1 through ZL18. The layout and size of the zone locations 18 is variable depending upon the application of counting system 10. In the embodiment shown, zone locations 18 are designed for sensing pedestrian traffic through a three foot doorway. Thus, by employing assumptions of the size of a human foot, the distance spanned by a walking step, and the space occupied by a human traveling across sensor mat 12, sensor mat 12 is divided into eighteen six-by-six inch square zone locations 18. Each zone location 18 includes a normally opened, pressure actuated switch 20 (only one shown in ZL6) which closes when an object, such as a human foot, makes contact with any portion of the zone location. Of course, one skilled in the art could readily implement the switching function of switches 20 using, for example, light sensitive switches, magnetically actuated switches, heat sensitive switches, piezo-electric switches, piezo-resistive switches, or even resistance sensors. When actuated, switches 20 produce contact event signals which are sensed by microprocessor 14 across conductors 22 (only one shown).

Microprocessor 14 includes an input section 30 connected to sensor mat 12 by conductors 22. Conductors 22 also route switches 20 to an interrupt logic circuit 35 (described in further detail below) which supplies an interrupt signal to microprocessor 14 or conductor 23 when any one of the switches 20 is actuated. The interrupt signal interrupts analysis of contact events and causes microprocessor 14 to record the zone location corresponding to the activated switch 20. Microprocessor 14 includes software latches 32 which correspond to the switches 20 in zone locations 18. Microprocessor 14 also includes a timer 33, a programmable memory 24 for storing predetermined criteria 26 and application software 28 (described below), a random access memory 34, and an output section 36. Various conventional microprocessors may be used, for example, the PIC17C44 made by Microchip. Output section 36 provides count signals to counter 16, which may be a conventional, off-the-shelf two-channel counter, across output conductors 38*a* and 38*b*. Counter 16 includes an "in" count register 17*a* having conductor 38*a* as an input, and an "out" count register 176 having conductor 38*b* as an input. Count registers 17*a*, 17*b* store count information corresponding to the number of objects traveling across sensor mat 12 in the "in" direction 40 and the "out" direction 42, which further corresponds to the number of objects present on the "in" side 44 and the "out" side 46 of sensor mat 12 as described in greater detail below. Counter 16 could also include a visual display of the count information and/or an audible indicator to indicate the passage of objects across sensor mat 12.

Figure 13:
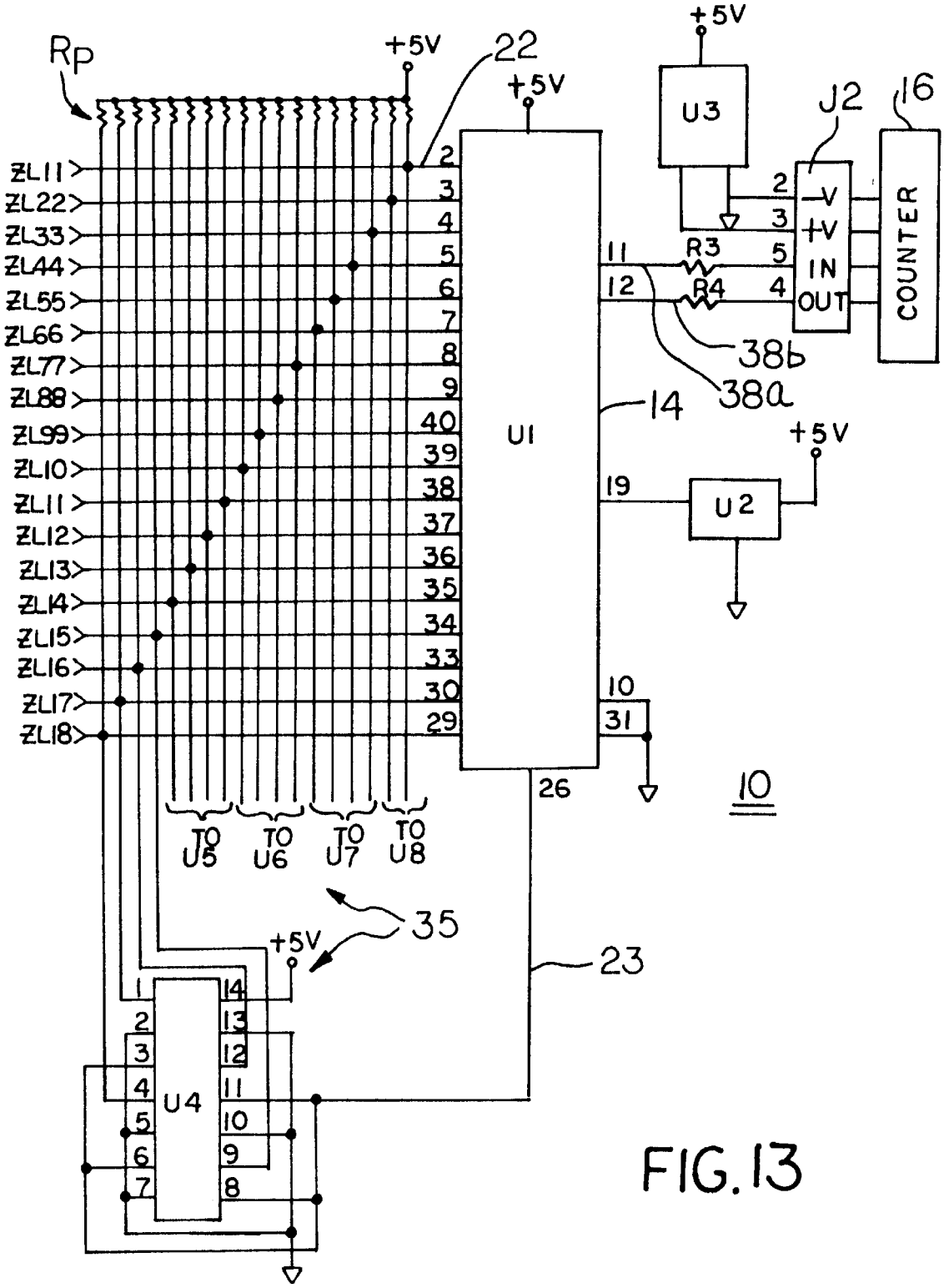
FIG. 13 is a schematic diagram of a counting system according to the present invention.

Referring now to FIG. 13, inputs ZL1 through ZL18 are connected to switches 20 in zone locations ZL1 through ZL18, respectively. Inputs ZL1 through ZL18 are pulled up to +5 volts by pull-up resistors Rp. Thus, when any switch 20 is actuated, its corresponding input (ZL1 through ZL18) to microprocessor 14 (U1) is connected to ground. Microprocessor 14 senses the change from logic high to logic low at the input and writes to memory 34 the zone location and timestamp associated with the contact event. Each input ZL1 through ZL18 is also routed to an interrupt logic circuit 35 which includes a plurality of NAND gates (U4 through U8). When any input ZL1 through ZL18 changes state to logic low, the logic interrupt circuit produces an interrupt signal on conductor 23. As described in greater detail below, microprocessor 14 stops execution of the analysis portion of software 28 upon receipt of an interrupt signal and records in memory 34 the zone location and timestamp associated with the actuated switch 20.

In this embodiment, U2 is a commonly available 4 Megahertz crystal oscillator which serves as a clock generator for microprocessor 14. U3 is a conventional +5 volt regulator which provides regulated power to the system 10. Conductors 38*a* and 38*b* are connected to microprocessor 14 output pins 11 and 12, respectively. When software 28 determines that an "in" or an "out" count should be provided to counter 16, one of the output pins 11 or 12 is driven high for approximately ten milliseconds and fed through a resistor (R3 or R4) to output connector J2. Output connector J2 routes the "in" or "out" count signal to the appropriate channel of two-channel counter 16, resulting in an increase of the number stored in the corresponding count register 17*a*, 17*b* as best shown in FIG. 1.

The following description of the operation of counting system 10 assumes that the system is employed to count people traveling into and out of a room through a doorway. In general, as a person walks across sensor mat 12, one or both of the person's feet make contact with one or more of the zone locations 18. Each contact with a zone location 18 is referred to as a "contact event." The scanning operation of the microprocessor 14 processes and stores the number of the zone location contacted and the time of contact for each contact event. The switches 20 within the contacted zone locations 18 produce contact event signals which are sensed at input section 30 of microprocessor 14. These signals are received by input section 30 of microprocessor 14. Each switch 20 has a dedicated software latch 32 within microprocessor 14, thereby enabling microprocessor 14 to determine the zone location corresponding to the contact event. Timer 33 timestamps each contact event when it changes the state of a latch 32. Microprocessor 14 stores the zone location and timestamp corresponding to each contact event in random access memory 34. During periods of time when microprocessor 14 is not scanning contact events (i.e., when there is no traffic across sensor mat 12), microprocessor 14 employs the event analysis operation of application software 28 stored in programmable memory 24 to analyze the contact events. The analysis determines the number of people that traveled across mat 12 and the direction of their travel during the most recent traffic sequence as described in greater detail below. This information is outputted to counter 16 in the form of an "in" count on conductor 38*a* or an "out" count on conductor 38*b*.

Figure 2:
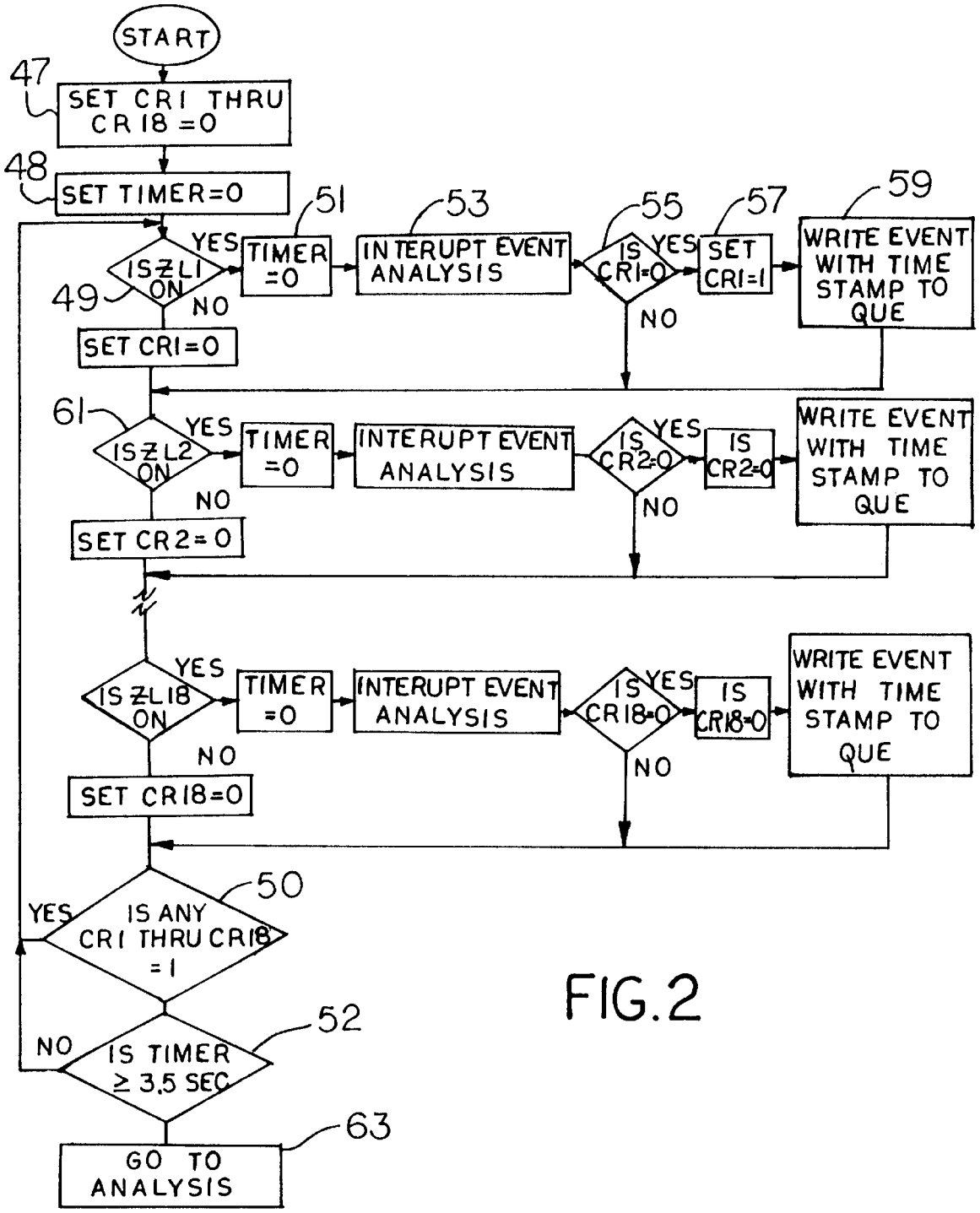
FIG. 2 is a logic diagram of the scanning operation of the software of the present invention.

The scanning operation is carried out by application software 28 in the manner depicted in the flow diagram of FIG. 2. As the rate of scanning must be relatively rapid to ensure that each contact event is detected, logic is employed to avoid multiple counting of contact events corresponding to individuals having a very slow walking pace or an individual standing on sensor mat 12. As shown in the figure, each software latch 32 (CR1–CR18) is initially set to logic zero at operation block 47. An internal scanning timer (based on timer 33) is also preset to zero at operation block 48. Each scanning pass carried out by the scanning operation sequentially polls each of the switches 20 in each zone location 18 (ZL1–ZL18). First, decision block 49 of software 28 determines if ZL1 is actuated (i.e., the switch 20 in zone location ZL1 is closed due to contact with the zone location). Assuming a person is currently contacting zone location ZL1, switch 20 within ZL1 is actuated and the scanning timer is again set to zero at operation block 51. Also, if software 28 is currently executing an event analysis operation, that operation is interrupted at operation block 53. Decision block 55 determines whether software latch CR1 is set to logic zero (which it was at operation block 47 at the beginning of the scan). If latch CR1 was previously set to logic zero, the present contact with zone location ZL1 represents an uncounted contact event. Thus, software latch CR1 is set to logic one at block 57 and software 28 reads timer 33 to assign a timestamp (i.e., an actual time of occurrence of this contact event relative to the beginning of this scanning operation). The timestamp and zone location information corresponding to the contact event is written to and stored in random access memory 34 at operation block 59.

Software 28 proceeds to poll the switch 20 within zone location ZL2 at decision block 61. Assuming nothing is contacting zone location ZL2, the software latch 32 corresponding to zone location ZL2 (i.e., latch CR2) is again set to logic zero (all latches were set to logic zero at the beginning of the scanning operation). Software 28 continues to poll the remaining zone locations 18, recording timestamp and zone location information corresponding to each actuated switch 20. After software 28 polls zone location ZL18, decision block 50 checks the status of the software latches in latch section 32 to determine if any latch is set to logic one. In this example, software latch CR1 was previously set to logic one. Thus, software 28 repeats the scanning operation.

Assuming the person contacting zone location ZL1 has left, and no further contact events occur, the scanning timer will continue to measure elapsed time as additional scanning operations are performed. When software 28 next reaches decision block 50, all of the software latches CR1–CR18 will be set to logic zero because software latch CR1 will have been set to zero after the switch 20 within zone location ZL1 was polled in the absence of a footstep. Accordingly, when software 28 reaches decision block 52, software 28 reads the scanning timer to determine the elapsed time from the latest contact event. Software 28 compares this elapsed time to a preset time limit, for example, 3.5 seconds. Since each scanning operation of all eighteen zone locations is relatively rapid (on the order of 20 microseconds), the first several results of decision block 52 will be "no" as the scanning timer will not yet have measured an elapsed time of 3.5 seconds. Eventually, assuming no intervening contact events occur, the scanning timer will meet or exceed 3.5 seconds and software 28 will begin execution of an event analysis operation as described below. It should be apparent from the foregoing that the scanning operation takes priority over the event analysis operation.

Once control of software 28 passes to the event analysis operation (at block 63 of FIG. 2), a preliminary filtering operation is carried out by the event que analysis portion of software 28. In general, the event que analysis portion functions to filter "straddler" contact events which occur when an object, such as a human foot, simultaneously contacts two adjacent zone locations 18 within one of the three rows of mat 12. Obviously, such simultaneous contact events need only be counted as a single event. Thus, the event que analysis logic detects such simultaneous contact events and filters out or discards all "straddler" events, maintaining only the last generated contact for analysis by the event analysis operation. The operation of the event que analysis and the event analysis portions of software 28, depicted in block diagram form in FIGS. 4 through 10*b* will be described in the context of an example traffic sequence illustrated in FIG. 3.

Figure 3:
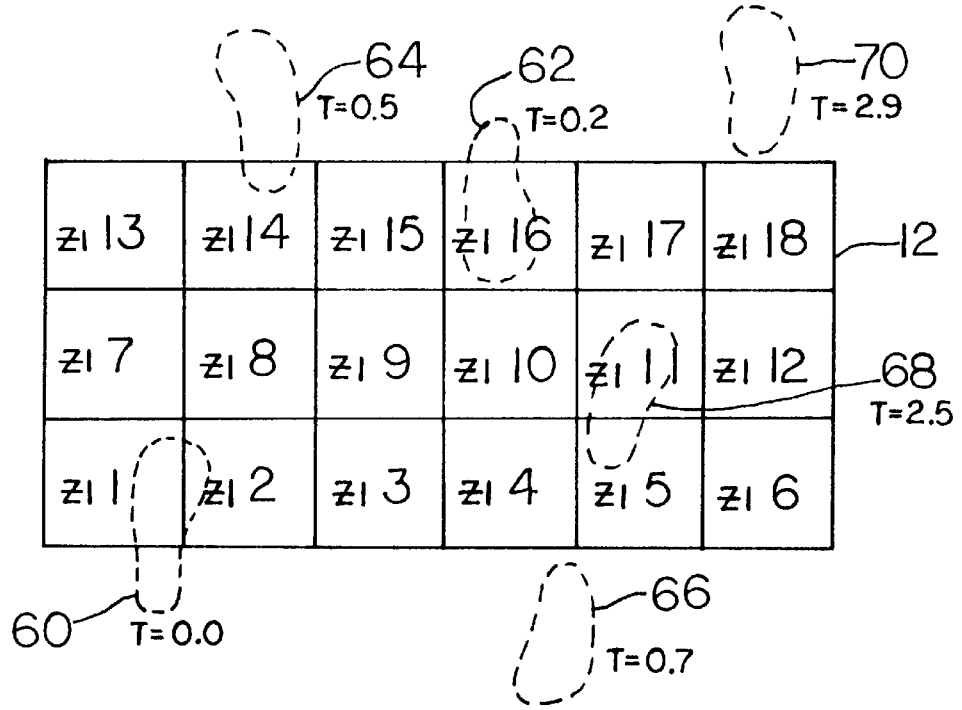
FIG. 3 is a conceptual diagram illustrating a traffic sequence and the resulting data.

FIG. 3 shows sensor mat 12 including zone locations ZL1–ZL18. Footsteps 60–70 represent a traffic sequence across sensor mat 12. Footsteps 60 and 64 correspond to the steps taken by an individual walking across sensor mat 12 in the "in" direction (person A). Footsteps 62 and 66 correspond to the steps taken by an individual walking across mat 12 in the "out" direction (person B). Finally, footsteps 68 and 70 represent an individual walking across mat 12 in the "in" direction (person C). By way of example, the chronological sequence of steps begins at time T=0 when footstep 60 simultaneously contacts zone locations ZL1 and ZL2. Before person A takes a next step, person B contacts zone location ZL16 with footstep 62 at time T=0.2. Next, person A takes a second step, contacting zone location ZL14 with footstep 64 at time T=0.5. Person B's next step, footstep 66, occurs at time T=0.7 but does not contact sensor mat 12. Shortly after persons A and B walk across mat 12, at time T=2.5, person C's first step (footstep 68) simultaneously contacts zone locations ZL5 and ZL11. At time T=2.9, person C's footstep 70 occurs, but does not contact sensor mat 12.

Tables 3*a*–3*d* represent the operations performed by software 28 during the event analysis operation of the above-described traffic sequence. Of course, as the footsteps contact sensor mat 12, the scanning operation of software 28 polls zone locations 18 and writes the timestamp and zone location information corresponding to the associated contact events to random access memory 34. In Tables 3*a,* rows Q1–Q6 represent que positions in random access memory 34. Initially, Q1 stores information related to the first recorded contact event of the traffic sequence. Q2 stores information related to the next recorded contact event, and so on. In this embodiment, the system is configured to store 20 contact events and analyze up to six at a time. It is to be understood that the event que could readily be expanded beyond twenty events and software 28 could be modified to analyze more than six contact events at a time. In each of the tables, the first column contains variables, Q1–Q6 in Table 3*a* and QA–QF in the remaining tables, which are assigned to the contact events for analysis as described below. The second column represents the zone location 18 of the contact event. The third column contains the timestamp. The fourth column represents a calculation of the elapsed time between sequential contact events.

Referring now to Table 3*a* of FIG. 3, the contact events generated by footstep 60 are stored in que positions Q1 and Q2. Information describing the zone location and timestamp of the next contact event encountered in the traffic sequence, generated by footstep 62, is stored in que position Q3. Q4 contains information generated by footstep 64. Note that, since footstep 66 did not generate a contact event, no information corresponding to footstep 66 is stored in random access memory 34. Que positions Q5 and Q6 contain contact event information resulting from footstep 68. Footstep 70 also did not produce a contact event. Since only six que positions are allocated in this embodiment, any additional contact events occurring during a traffic sequence are stored in subsequent positions Q7–Q20 (not shown). Any data stored in these additional positions is analyzed in turn, six at a time, in a manner described below. As mentioned, contact events that occur during the analysis operation interrupt software 28 and are written to the next sequentially available Q position.

Figure 4:
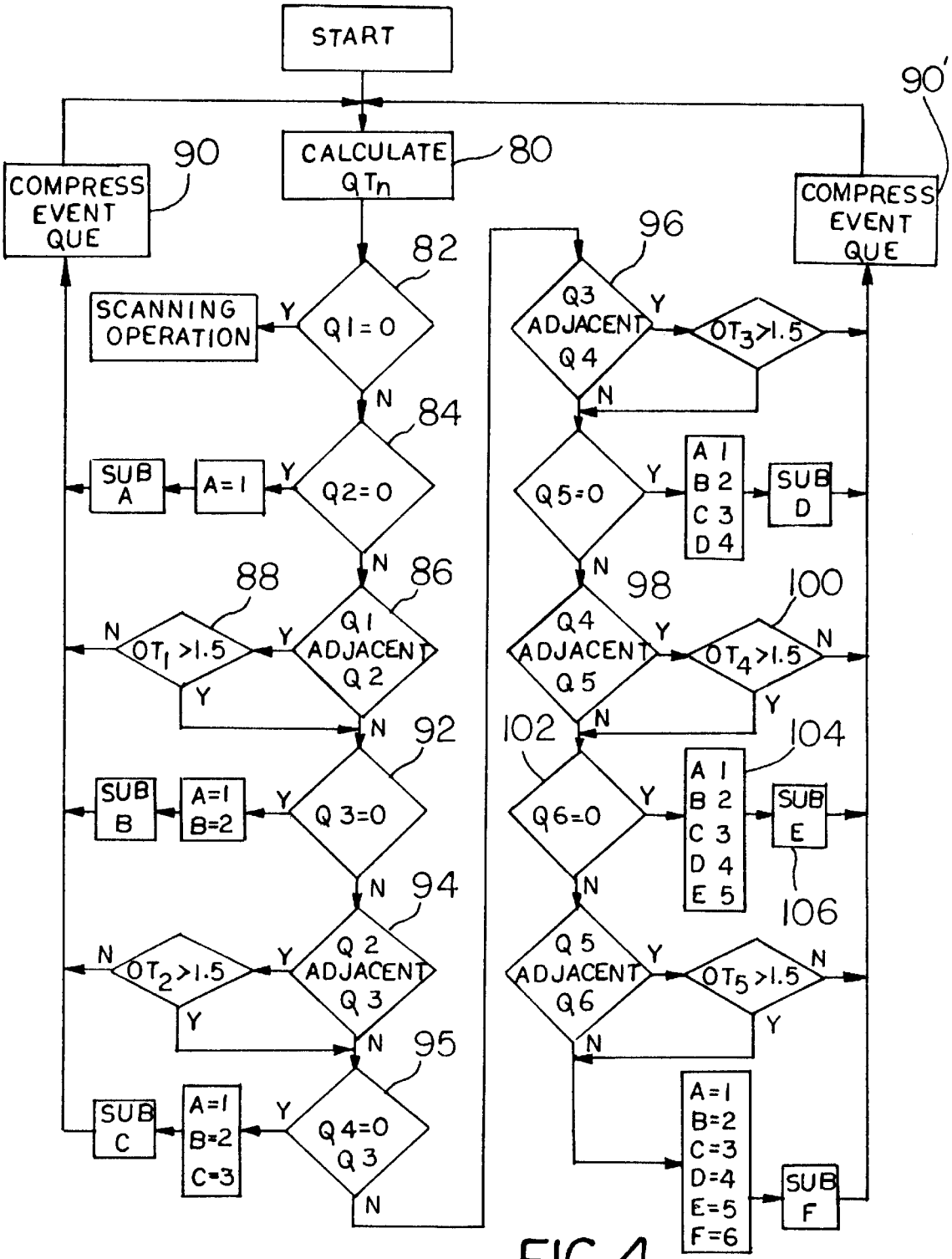
FIG. 4 is a logic diagram of the data filtering operation of the software of the present invention.
Figure 5:
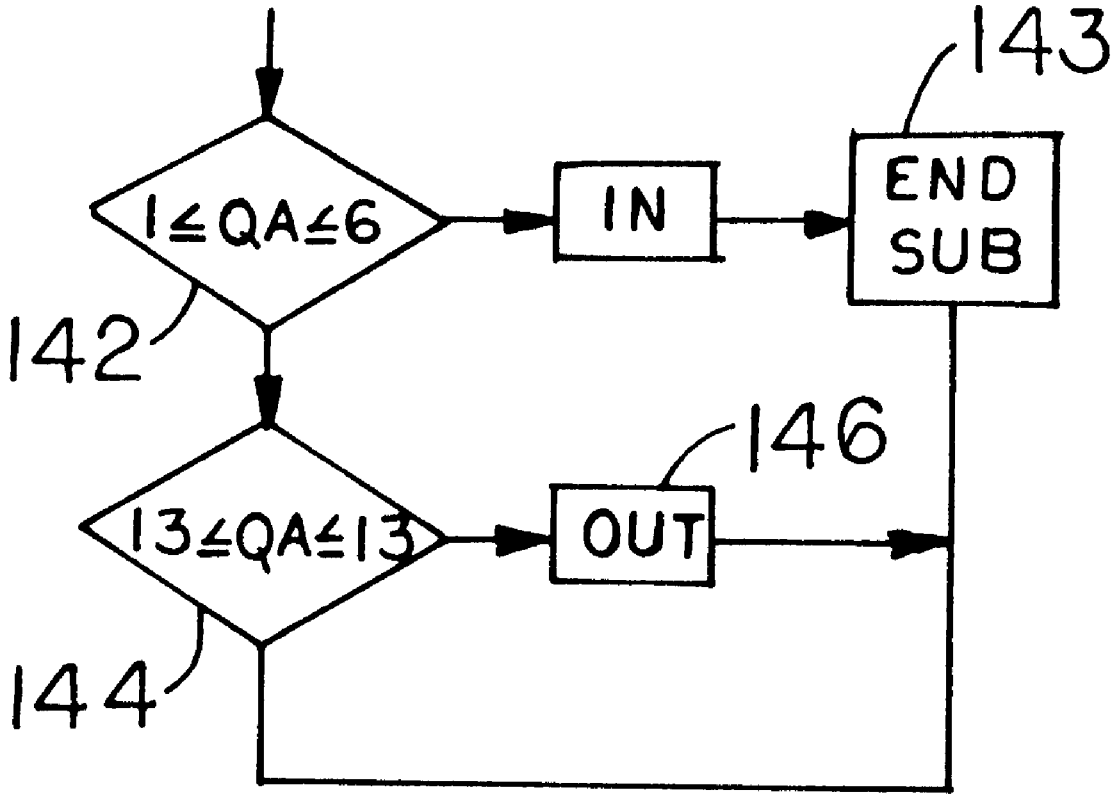
FIG. 5 is a logic diagram of a software subroutine for analyzing a single contact event.
Figure 6:
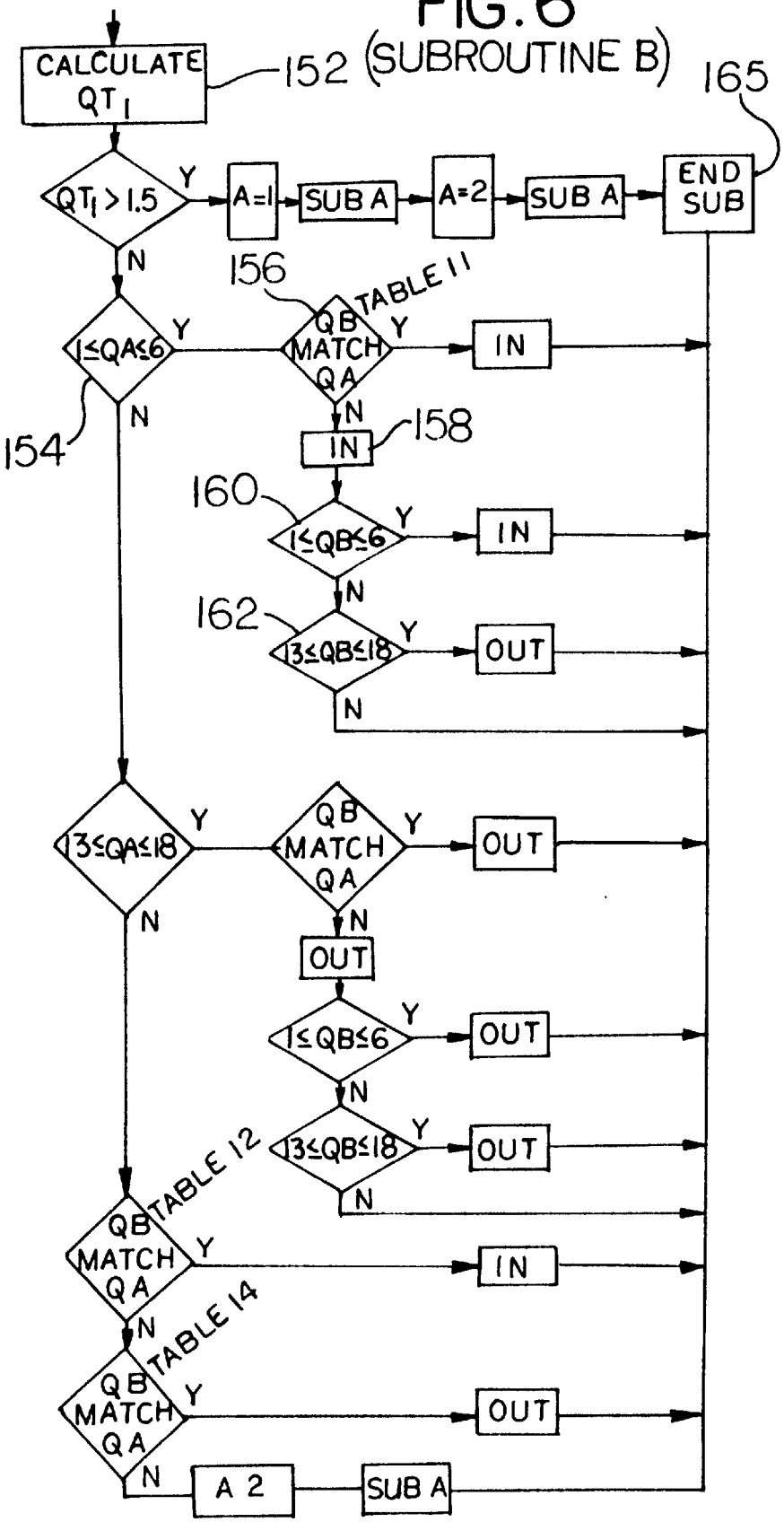
FIG. 6 is a logic diagram of a software subroutine for analyzing two contact events.
Figure 7:
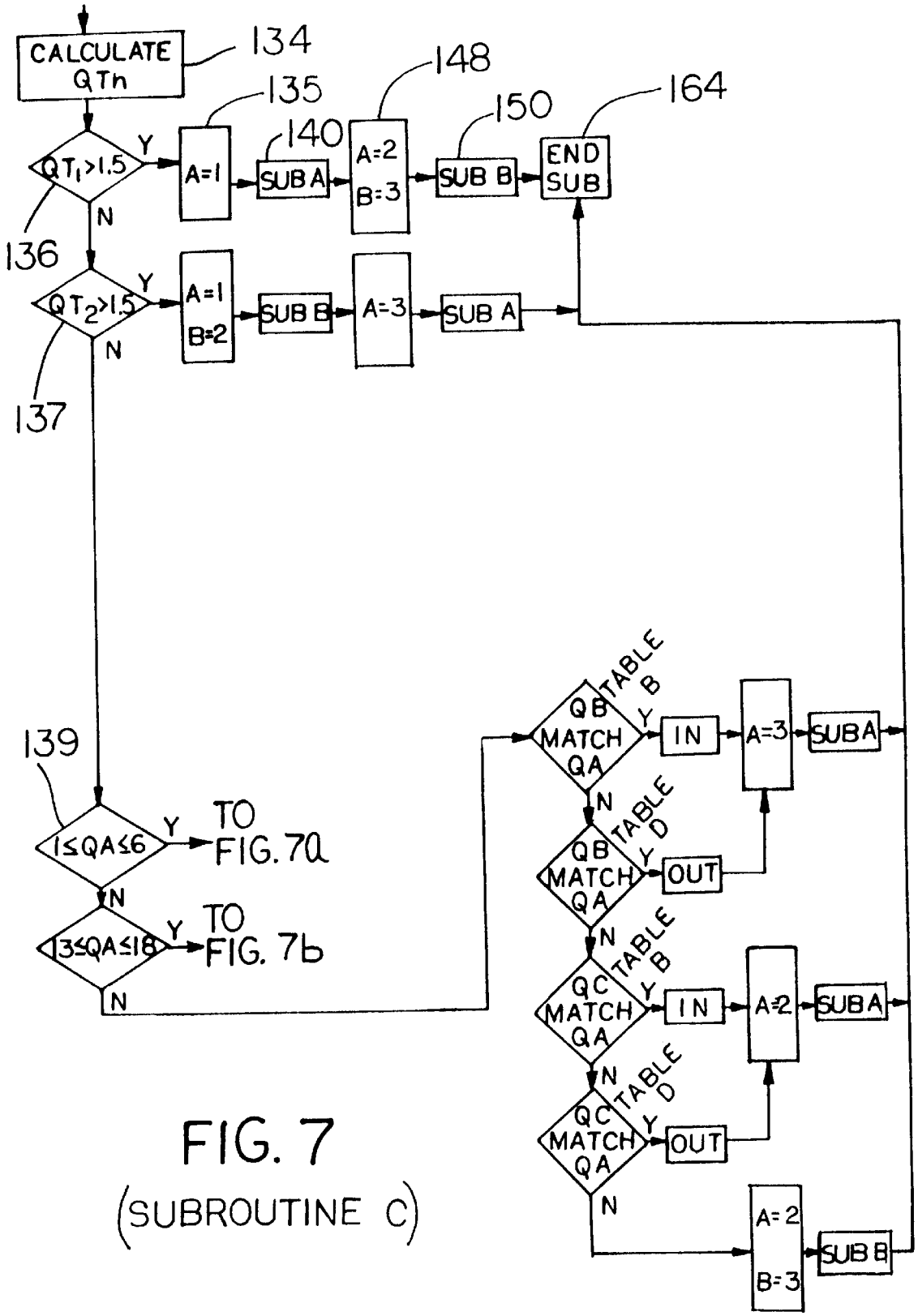
Figure 8:
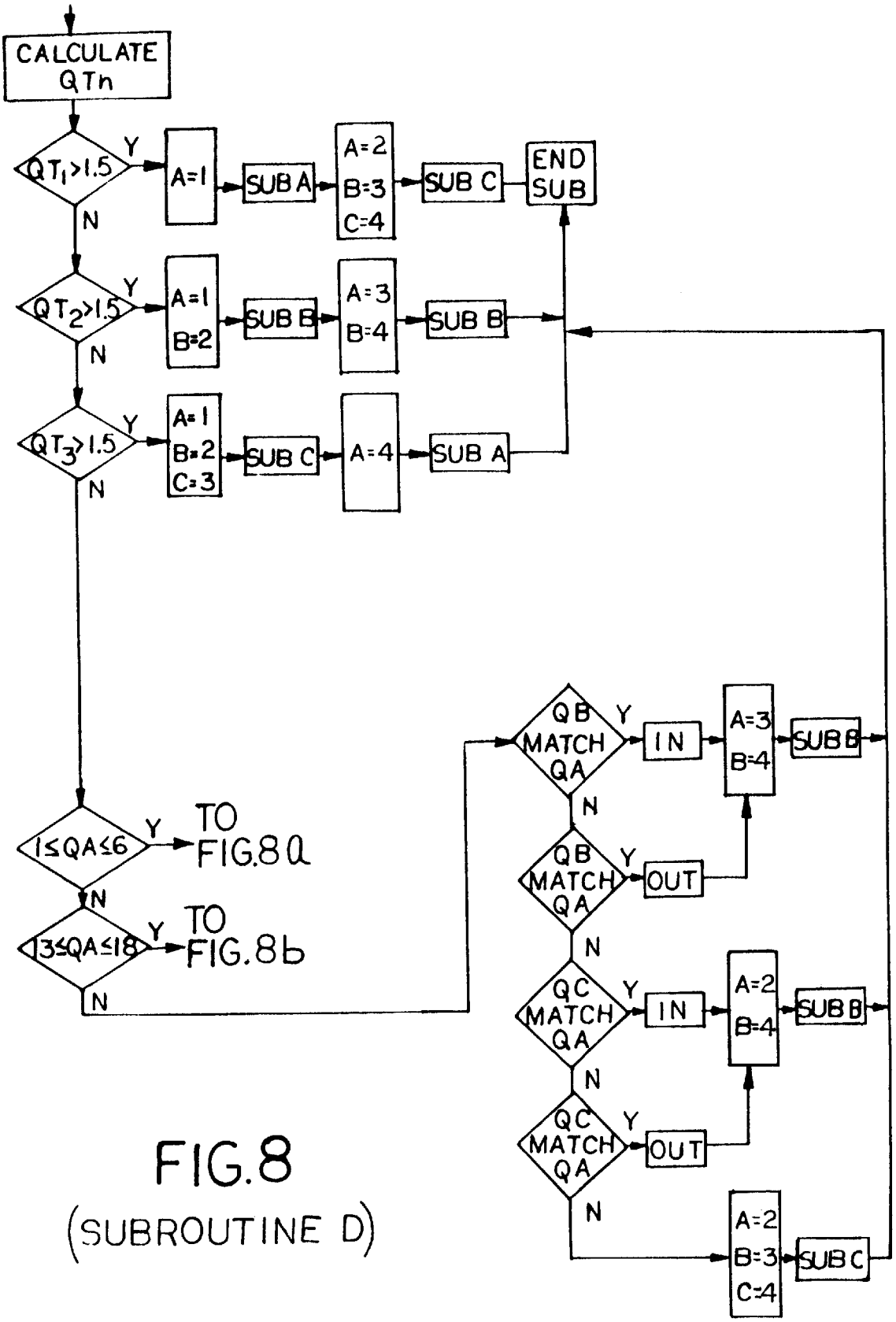
FIGS. 8, 8*a,* and 8*b* are logic diagrams of a software subroutine for analyzing four contact events.
Figure 8A:
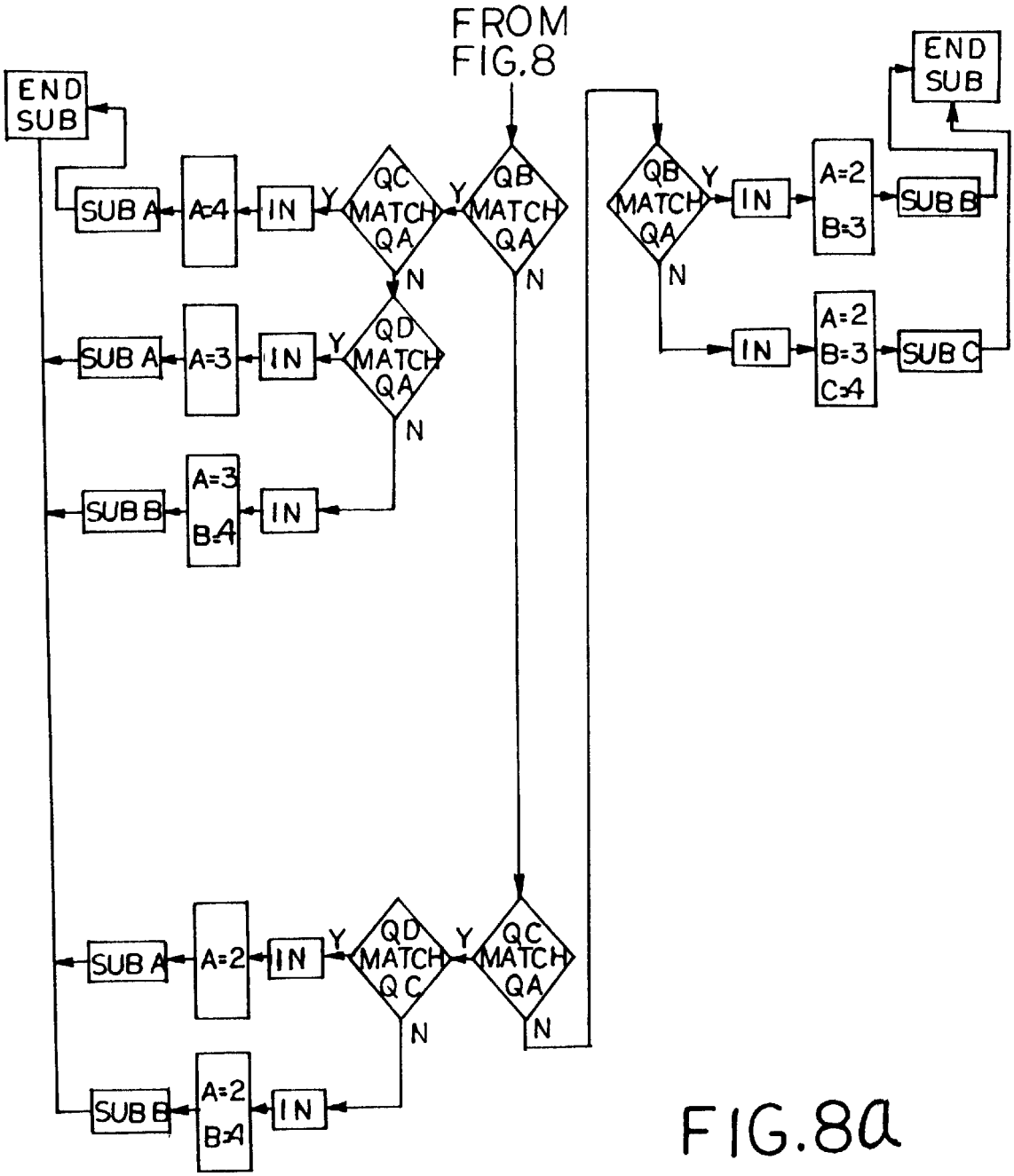
Figure 8B:
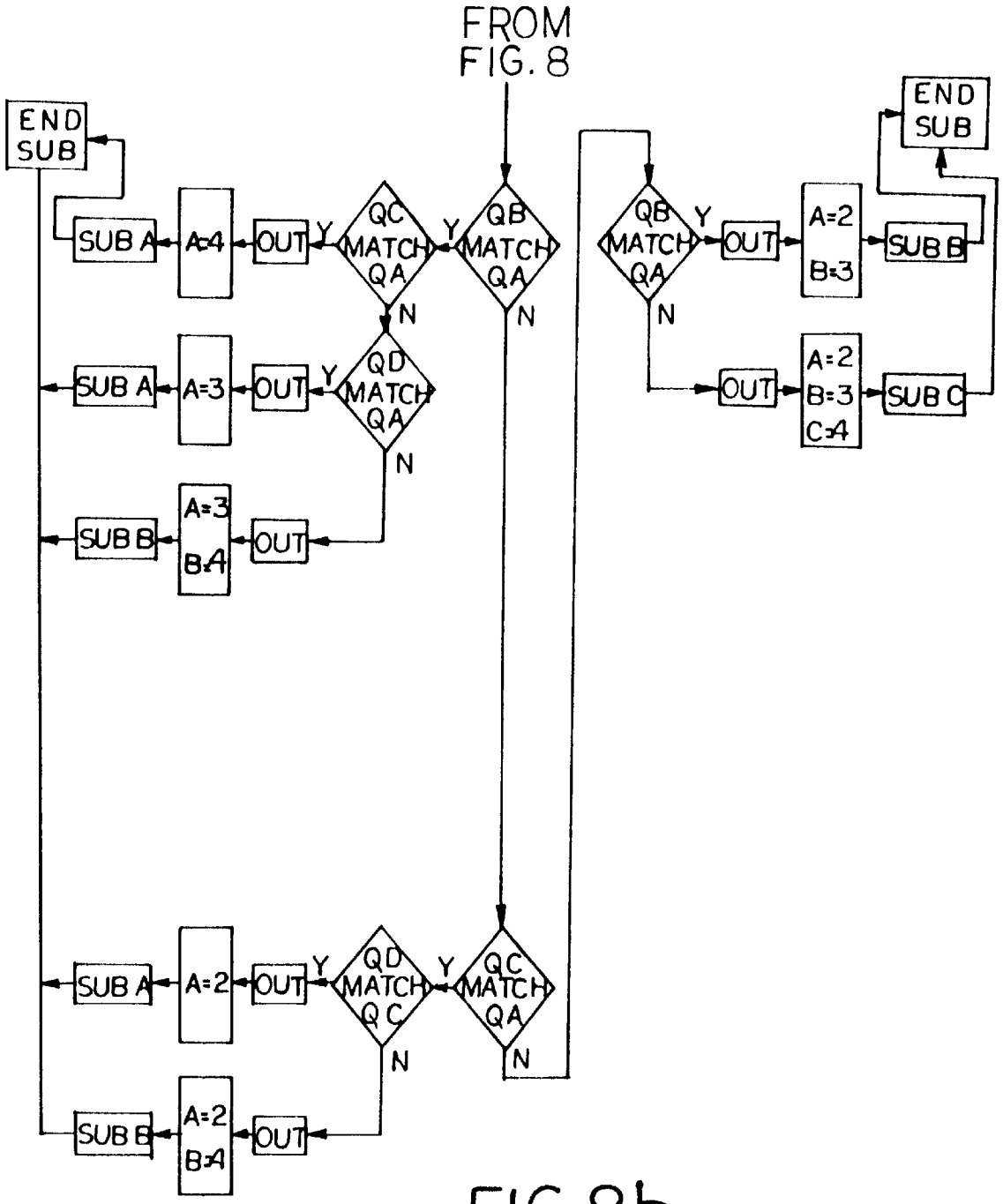

FIG. 4 shows the logic employed by the que analysis portion of software 28 which filters out "straddler" contact events and directs control to various subroutines of the contact event analysis operation. Software 28 assumes that one person can generate no more than three contact events with each passage across mat 12. Software 28 further assumes that contact events generated by a person passing across mat 12 are related spatially and temporarily. That is, as no two people can occupy the same space at the same time, software 28 uses the empirical value of 1.5 seconds as a temporal criteria to determine separate passages of people across the same location on mat 12. Additionally, software 28 uses the empirically derived Tables of FIGS. 11 and 12 as spatial criteria to separate people spatially when their temporal spacing is less than 1.5 seconds. Software 28 incorporates the following assumptions about the stride associated with a person traveling across sensor mat 12. Any time a contact event occurs in zone locations ZL1–ZL6 and software 28 determines that no other contact events were generated by the person who generated that singular contact event, software 28 assumes that the person associated with the event was traveling in the "in" direction and the next step was off mat 12. Similarly, any singular contact event occurring in zone locations ZL13–ZL18 results in a count signal to counter 16 representing a person traveling in the "out" direction. Finally, software 28 discards singular events which occur in zone locations ZL7–ZL12 since no direction of travel can logically be assigned. Such discarded events should be of little consequence since it is considered highly improbable that a person could step in one of the middle row zones without activating one of the outer row zones.

The basic function of the que analysis and contact event analysis operations of software 28 is to examine sequential contact events to determine whether they satisfy certain predetermined spatial criteria including the above-described assumptions. If the spatial criteria are met, software 28 determines whether the spatially related contact events satisfy certain predetermined temporal criteria. If the contact events are related both spatially and temporally, software 28 outputs a count signal to counter 16, pushes the related events out of the memory que, and continues analyzing subsequent contact events.

Referring now to FIG. 4, block 80 first calculates the elapsed time between the sequential contact events stored in the event que by accessing the timestamp information associated with each contact event. This operation generates the data shown in the QTn column of Table 3*a*. Decision block 82 determines whether a contact event is stored in que position Q1. Since Q1 contains a contact event, decision block 84 checks que position Q2. Since both positions are full, decision block 86 begins a "straddler" check by determining whether the zone locations 18 corresponding to the first two contact events are within the same row and adjacent (i.e., plus or minus one zone location). Since the zone locations are adjacent, decision block 88 determines whether their temporal relationship is within a preset 1.5 second maximum. If the contact events were generated more than 1.5 seconds from one another, software 28 assumes that they were generated by different people. In this example, the contact events occurred simultaneously. Thus, software 28 pushes the first generated "straddler" contact event from the event que as described below and shifts all of the remaining contact events in que positions Q2–Q20 into que positions Q1–Q19, with the value of Q20 being set to zero. This operation block as que compression, is performed by operation block 90. The resulting upwardly shifted table of contact events is shown in Table 3*b*.

Table 3*b* is organized as a second que with the variables QA–QF assigned to the data associated with Q2–Q7. Note that Q1 has been filtered out as a "straddler" event and QF is zero since no Q7 event was generated. Software 28 analyzes the contact events of Table 3*b*, as described below, thereby creating Tables 3*c* and 3*d*.

As shown in FIG. 4, the shifting operation described above directs operation of software 28 back to operation block 80 of the que analysis operation where time differentials between sequential contact events are again calculated. Since contact events are stored in both Q1 and Q2, the answer to decision blocks 82 and 84 is "no." Decision block 86 determines that the zone locations 18 of the first two contact events are not adjacent one another in the same row of mat 12. Thus, software 28 reaches decision block 92 which checks whether que position Q3 contains information. Since it does, decision block 94 checks whether the zone locations stored in que positions Q2 and Q3 are adjacent (i.e., checks for a "straddler" contact event). Zone location ZL16 and ZL14 are not adjacent. Decision block 95 determines that Q4 contains information, and decision block 96 checks whether zone locations ZL14 and ZL5 are adjacent. They are not. When software 28 reaches decision block 98, it determines that the zone locations stored in Q4 and Q5 (ZL5 and ZL11) are not within one zone location of one another in the same row. Decision block 102 determines that que position Q6 is empty. Consequently, software variables QA through QE are assigned to the zone location information stored in que positions Q1 through Q5, respectively, at operation block 104. This allows the original event que to remain in tact while software 28 analyzes the data. At operation block 106, the que analysis routine shifts control to subroutine E (shown in FIGS. 9, 9*a*, and 9*b*) which is designed to analyze a group of five contact events using the variables QA–QE.

Subroutine E initially calculates the time differences between the sequential contact events (i.e., QT1 through QT4) at operation block 108. Decision blocks 110, 112 determine that time differentials QT1 through QT2 are less than 1.5 seconds. Decision block 114 determines that QT3 (i.e., the difference between Q3 and Q4, shown in Table 3*b* as 2.0 seconds) is greater than 1.5 seconds. Thus, variables QA, QB, and QC are assigned at operation block 115 to the contact event data in que positions Q1, Q2, and Q3, respectively. Operation block 117 shifts control of software 20 to subroutine C (shown in FIGS. 7, 7*a*, and 7*b*) which analyzes the data of Table 3*c*.

Block 134 of subroutine C first calculates the time difference between QA and QB, and QB and QC. At decision blocks 136 and 137, software 20 determines that QT1 and QT2 are less than 1.5 seconds. At decision block 139, software 20 determines that ZL2 (assigned the variable QA) is in the first row of sensor mat 12. Upon making such a determination, software 20 may properly impose a predetermined set of spatial criteria to the zone locations associated with QA and QB to derive their spatial relationship, if any.

The sets of predetermined spatial criteria are shown in Tables 11 through 14 (FIGS. 11 and 12) and reflect the above-described assumptions about the footsteps expected during a person's passage across sensor mat 12. Table 11 is used by the event analysis operation to evaluate up to three contact events which begin with a contact event occurring in one of the first six zone locations (ZL1 through ZL6). Table 12 constitutes the predetermined spatial criteria for up to three related contact events beginning with a footstep on any one of zone locations ZL7 through ZL12. When the zone locations 18 of the first and second or the first and third contact events satisfy the criteria shown in Table 11 or Table 12, an "in" count signal is generated by microprocessor 14 as described in greater detail below. Similarly, Tables 13 and 14 represent the predetermined spatial criteria for generating "out" counts.

Returning now to the example and the flow diagram of FIG. 7*a*, since zone location ZL2 is associated with QA, when the event analysis routine reaches decision block 200, software 28 refers to Table 11 to evaluate the spatial relationship between the zone locations associated with QA and QB. Specifically, software 28 checks whether the zone location associated with QB is ZL7, ZL8, ZL9, or ZL14. Reference to the mat diagram of FIG. 3 clarifies the organization of Tables 11 through 14. Given the first contact event occurred in zone location ZL2 (the "straddler" in zone location ZL1 having been filtered out), one would logically expect the next step of a person walking in the "in" direction to make contact with any one of the zone locations ZL7, ZL8, ZL9, or ZL14. Similar grouping of contiguous zone locations is reflected in Tables 11 through 14. Since zone location ZL16 (stored in QB) does not satisfy the criteria of Table 11, the event analysis operation proceeds to decision block 202.

Decision block 202 checks whether the zone location corresponding to the third contact event (assigned the variable QC) satisfies the criteria of Table 11. Of course, zone location ZL14 constitutes a "match" and software 28 generates an "in" count signal at operation block 204 which is transmitted by output section 36 to counter 16 across output conductors 38. Accordingly, count register 17 is incremented thereby recording the passage of the individual taking footsteps 60 and 64 in the "in" direction across sensor mat 16.

Next, operation block 205 assigns the zone location associated with Q2 (and the associated timestamp) to the variable QA. The Q2 information is the data associated with footstep 62 (i.e., zone location ZL16 and timestamp 0.2 seconds). Block 207 transfers control of software 28 to subroutine A FIG. 5) which is designed to analyze single contact events. Subroutine A begins by determining whether the zone location of the singular contact is within the first row (decision block 142) or the last row (decision block 144) of the sensor mat 12. Since ZL16 is one of the last row zone locations, block 146 causes microprocessor 14 to generate an "out" count which is passed on to counter 16. Counter 16 increments the "out" count register 17*b* thereby recording the passage of person "B" across sensor mat 12 in the "out" direction. Finally, the "End Subroutine" block 143 transfers control back to operation block 207 of subroutine C (FIG.

Figure 9:
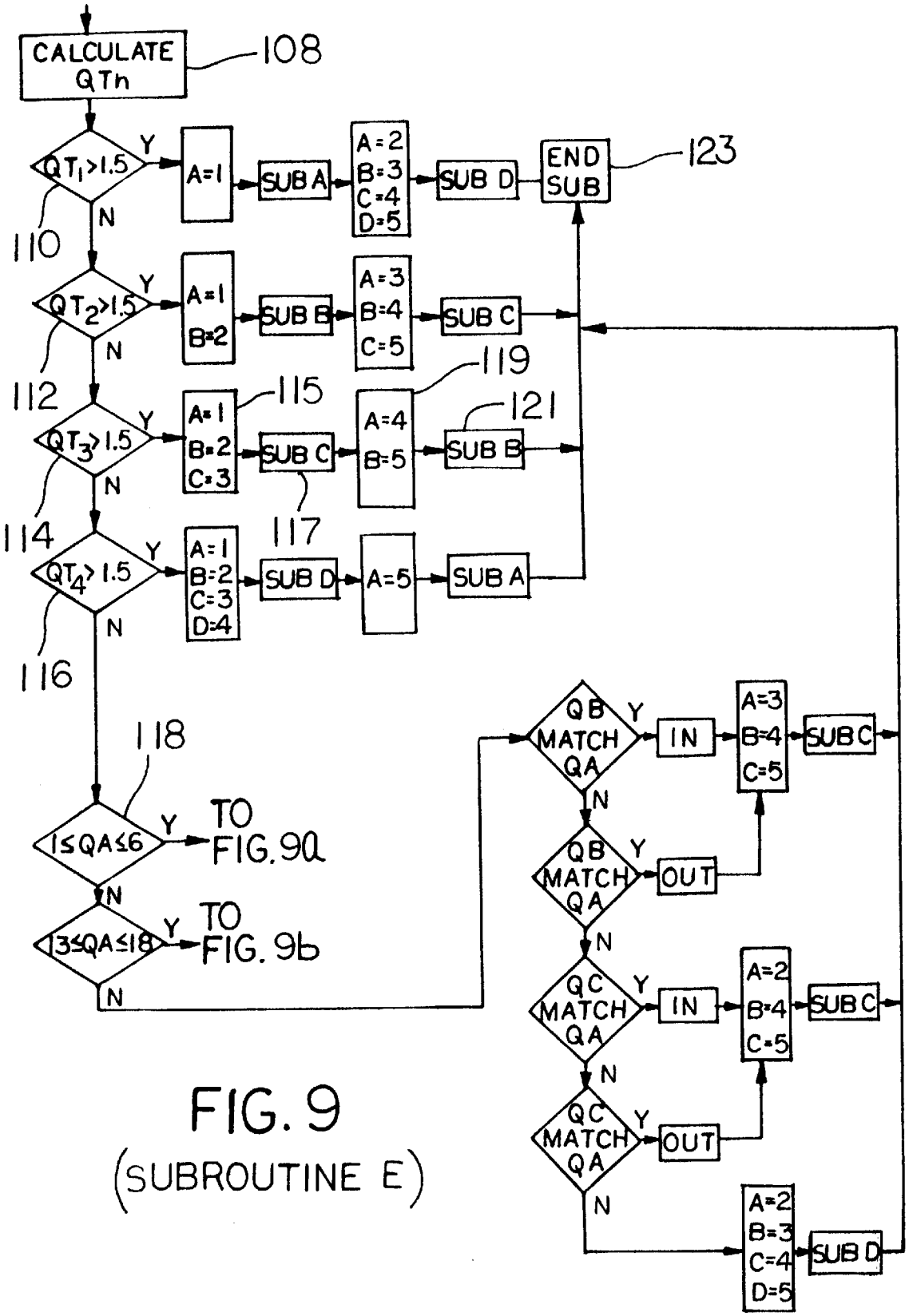
FIGS. 9, 9*a,* and 9*b* are logic diagrams of a software subroutine for analyzing five contact events.
Figure 9A:
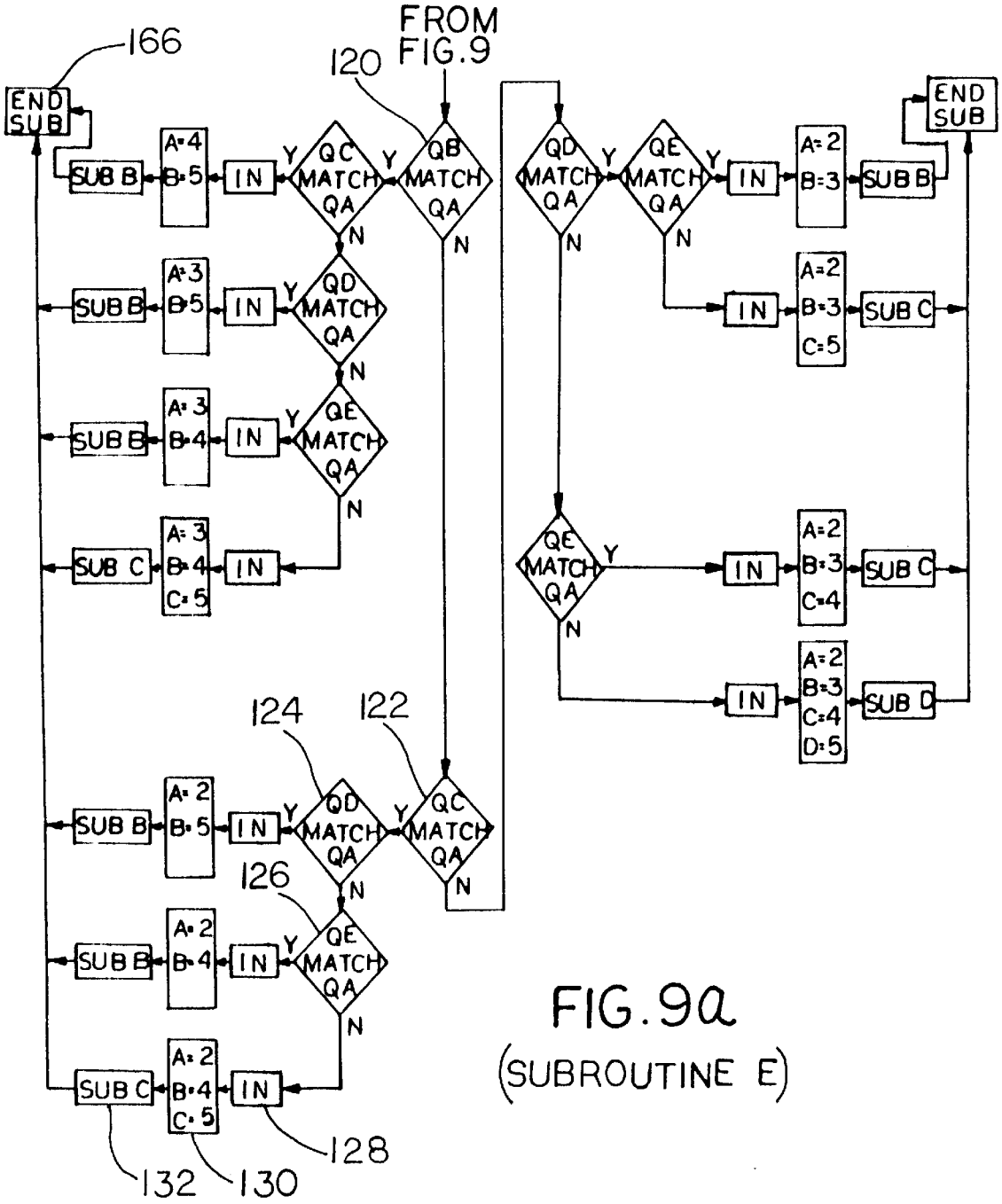
Figure 9B:
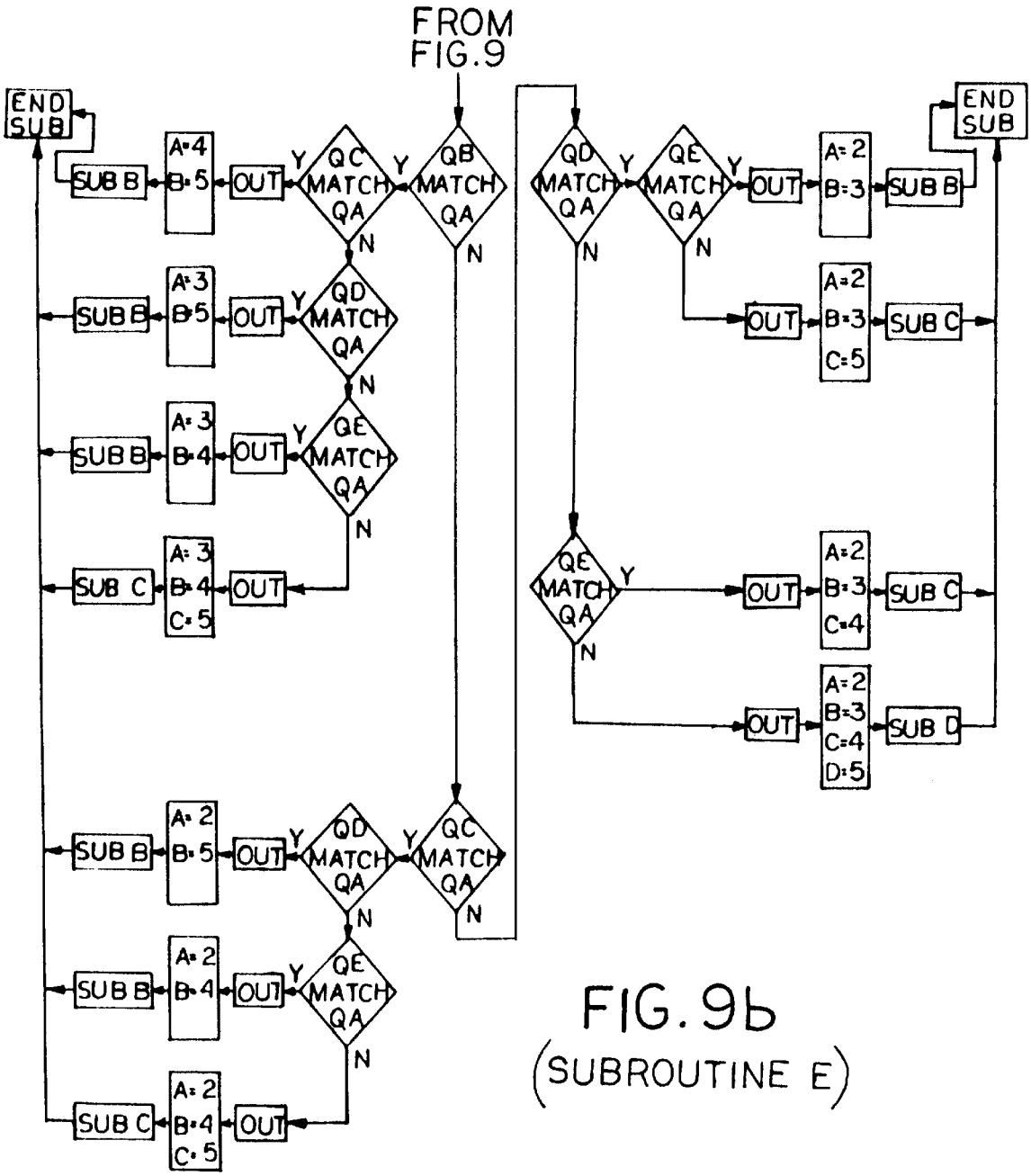
Figure 10:
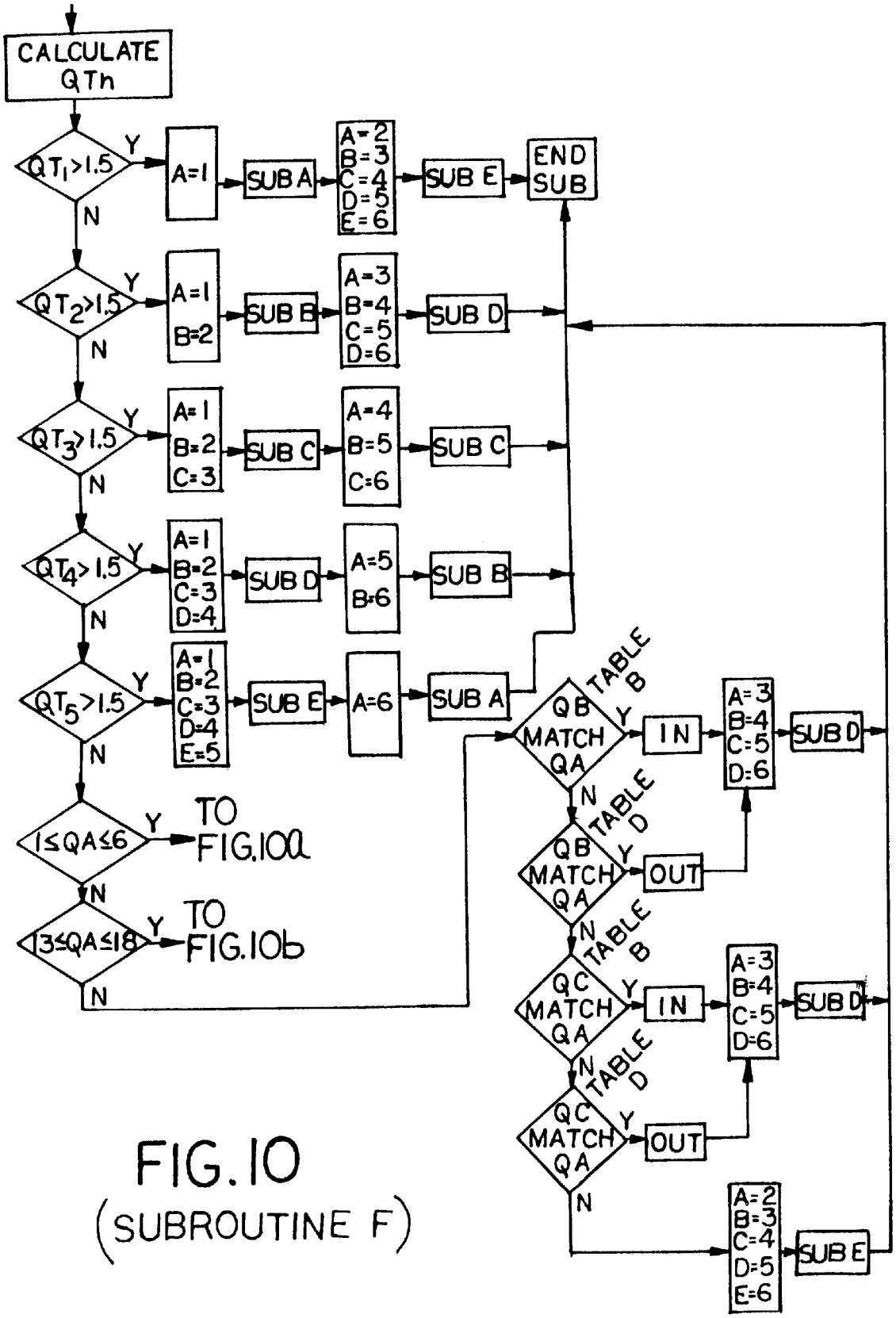
FIG. 10, 10*a,* and 10*b* is a logic diagram of a software subroutine for analyzing six contact events.
Figure 10A:
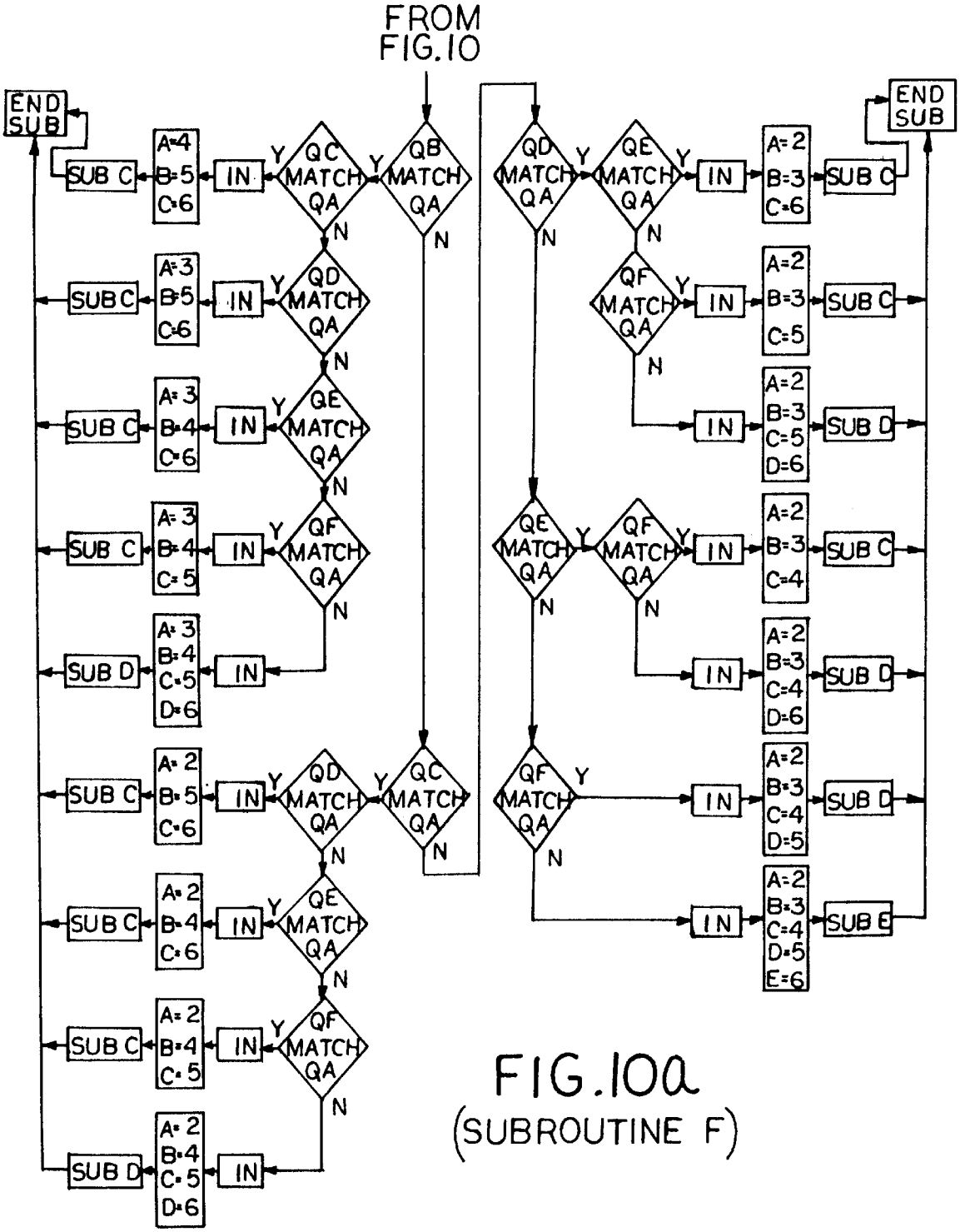
Figure 10B:
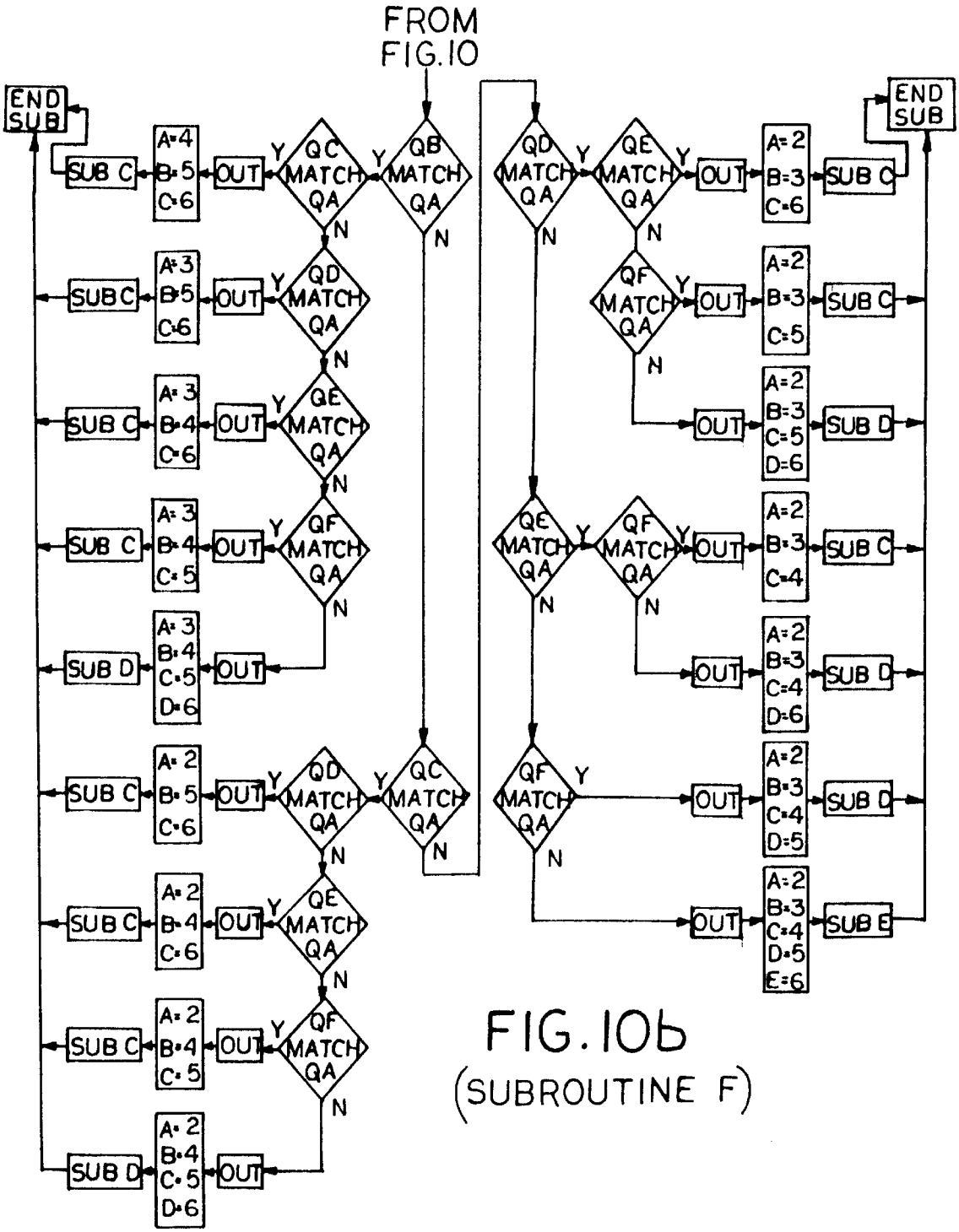

7*a*). The "End Subroutine" block 209 of subroutine C likewise transfers control back to operation block 117 of subroutine E (FIG. 9). In summary, software 28, through use of the filtering operation of FIG. 4 and the logic of subroutines E, C, and A, determined that footsteps 60 and 64 were generated by a person walking into the area and that the single footstep 62 corresponded to a person walking out of the area.

To analyze the remaining two contact events, block 119 assigns the variables QA and QB to the zone location and time stamp information stored in que positions Q4 and Q5, respectively. The resulting data is shown in Table 3*d* of FIG. 3. Operation block 121 calls subroutine B (designed to analyze two contact events). At operation block 152, subroutine B first calculates the time difference between the timestamps of QA and QB. Since the time difference is not greater than 1.5 seconds, decision block 154 determines whether the zone location of QA (i.e., ZL5) is within the first row of zone locations. Decision block 156 uses Table 11 to determine whether the zone locations of QA and QB are spatially related. More specifically, since QA is ZL5, decision block 156 checks Table 11 to determine if zone location QB is ZL10, ZL11, ZL12, or ZL17. Since ZL11 meets this predetermined spatial relationship criteria, operation block 158 generates an "in" count which is transmitted to counter 16 and recorded "in" count register 17*a*. The "End Subroutine" operation block 165 transfers control back to block 121 of subroutine E (FIG. 9). The "End Subroutine" block 123 of FIG. 9 transfers control back to block 106 of the filtering operation of FIG. 4. Operation block 90' of FIG. 4 clears the que positions Q1 through Q6 and shifts any contact event data from position Q7 and below, up to Q1 sequentially. The next set of six events is thus ready for analysis. Since no additional data was generated by the example traffic sequence, when decision block 82 of FIG. 4 checks the contents of que position Q1, it determines that no data is stored, and operation block 83 transfers control of software 28 back to the scanning operation of FIG. 2. Microprocessor 14 scans sensor mat 12 until additional contact events are sensed. These events are then filtered and analyzed in the manner described above.

As should be apparent from the foregoing, subroutine D (which analyzes four contact events) and subroutine F (which analyzes six contact events) perform substantially the same functions as those described above in the context of the subroutines. The basic logic of determining the zone location of the first contact location in a group of events, and determining whether the subsequent event(s) satisfy the predetermined spatial criteria of Tables 11 through 14 is simply adapted to logic designed to process a different initial number of contact events.

While this invention has been described as having exemplary embodiments, this application is intended to cover any variations, uses, or adaptations of the invention using its general principles. Further, this application is intended to cover such departures from the present disclosure as come within the known or customary practice within the art to which it pertains. The spirit and scope of the invention are to be limited only by the terms of the appended claims.

What is claimed is:

1. Method of determining the direction of travel of objects traveling across a surface having a plurality of zone locations, comprising the steps of:

sensing contact events between the surface and the objects traveling across the surface;

recording a timestamp and a zone location corresponding to each contact event;

identifying contact event sequences according to predetermined criteria defining relationships between the timestamps and the zone locations corresponding to the contact events;

relating individual objects to individual contact event sequences; and assigning a direction of travel to the individual objects according to the predetermined criteria.

2. The method of claim 1 further comprising the step of measuring elapsed time after sensing a contact event.

3. The method of claim 2 further comprising the step of comparing the elapsed time to a predetermined time limit.

4. The method of claim 1 further comprising the step of calculating the elapsed time between sequential contact events.

5. The method of claim 1 further comprising the step of identifying groups of straddled contact events.

6. The method of claim 5 further comprising the step of eliminating all but one contact event from each group of straddled contact events before identifying contact event sequences.

7. The method of claim 1 wherein the step of sensing contact events includes the step of scanning the zone locations.

8. The method of claim 1 wherein the direction of travel assigned to the individual objects is one direction from the group of directions consisting of an inward direction and an outward direction.

9. The method of claim 8 further comprising the step of incrementing a first counter upon assigning an inward direction of travel and the step of incrementing a second counter upon assigning an outward direction of travel.

10. A counting apparatus, comprising:

a sensor surface having a plurality of zone locations, each zone location having a switch which outputs a contact event signal corresponding to the zone location when an object traveling across the sensor surface contacts the zone location;

a microprocessor connected to the switches, the microprocessor being adapted to receive and analyze the contact event signals according to predetermined criteria, the microprocessor producing a first signal when a sequence of contact event signals satisfies one set of criteria and a second signal when a sequence of contact event signals satisfies another set of criteria; and a counter connected to the microprocessor, the counter incrementing one count register in response to the first signal and incrementing a second count register in response to the second signal.

11. The counting apparatus of claim 10 wherein the microprocessor includes a memory.

12. The counting apparatus of claim 10 wherein the switches are pressure activated.

13. The counting apparatus of claim 11 wherein the memory stores the predetermined criteria and a logic algorithm for analyzing the contact event signals according to the predetermined criteria.

14. The counting apparatus of claim 10 wherein the microprocessor includes a timer for measuring the time associated with each contact event signal.

15. The counting apparatus of claim 14 wherein the predetermined criteria include spatial relationships between zone locations and temporal relationships between the times of the contact event signals for determining when two or more contact event signals were generated by the same object.

* * * * *